US005975635A

United States Patent [19]

Parpala

[11] Patent Number: 5,975,635

[45] Date of Patent: Nov. 2, 1999

[54] PORTABLE PEDESTAL SEAT

[76] Inventor: David Parpala, P.O. Box 312, La Habra, Calif. 92633

[21] Appl. No.: 09/005,721

[22] Filed: Jan. 12, 1998

Related U.S. Application Data

[63] Continuation-in-part of application No. 08/322,180, Feb. 16, 1995, abandoned, which is a continuation of application No. 08/088,162, Jul. 7, 1993, abandoned.

[51] Int. Cl.[6] ..... A47C 1/02

[52] U.S. Cl. ..... 297/338; 297/440.24; 297/188.08

[58] Field of Search ..... 297/344.18, 344.1, 297/344.12, 344.15, 344.21, 188.08, 188.09, 337, 338, DIG. 1, 440.24; 248/156–158, 161, 407, 423, 188.5; 108/148, 150, 147.19

[56] References Cited

U.S. PATENT DOCUMENTS

| | | |
|---|---|---|
| 1,218,357 | 3/1917 | Bauer . |
| 1,956,956 | 5/1934 | Leibo . |
| 2,607,398 | 8/1952 | Andrews . |
| 2,720,249 | 10/1955 | Peterson . |
| 2,877,828 | 3/1959 | Barnette, Jr. . |
| 3,139,696 | 7/1964 | Stucky et al. . |
| 3,225,734 | 12/1965 | Bule . |
| 3,283,733 | 11/1966 | Boerma . |
| 4,039,363 | 8/1977 | Robertson . |
| 4,085,686 | 4/1978 | Turner et al. . |
| 4,098,041 | 7/1978 | Frye . |
| 4,407,475 | 10/1983 | Gossage . |

FOREIGN PATENT DOCUMENTS

| | | |
|---|---|---|
| 8040185 | 4/1980 | Australia . |
| 465880 | 6/1950 | Canada . |
| 7612282 | 5/1978 | Netherlands . |

*Primary Examiner*—Milton Nelson, Jr.
*Attorney, Agent, or Firm*—Gene Scott-Patent Law & Venture Group

[57] ABSTRACT

A portable pedestal seat for use by bird watchers, duck hunters, fishermen, or the like, including a seat, and, for supporting the seat, an adjustable pedestal formed of a pair of tubes, the smaller of the tubes being slidably engaged within the other for extending the pedestal for adjusting the height of the seat. The free end of the inner tube is cut on a 45 degree bias and provides a terminal edge surface of such area as to prevent the pedestal seat from sinking into a typical soft ground surface by more than about 18 inches which is enough to support the seat in an upright attitude and to allow for relative ease in removal.

6 Claims, 2 Drawing Sheets

FIG. 7
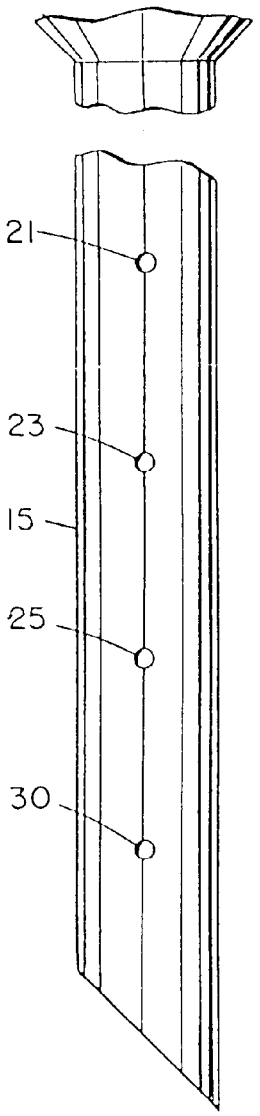
FIG. 8
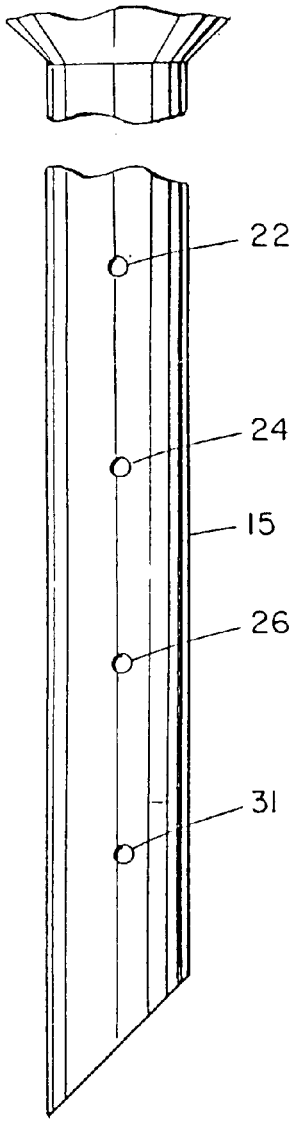
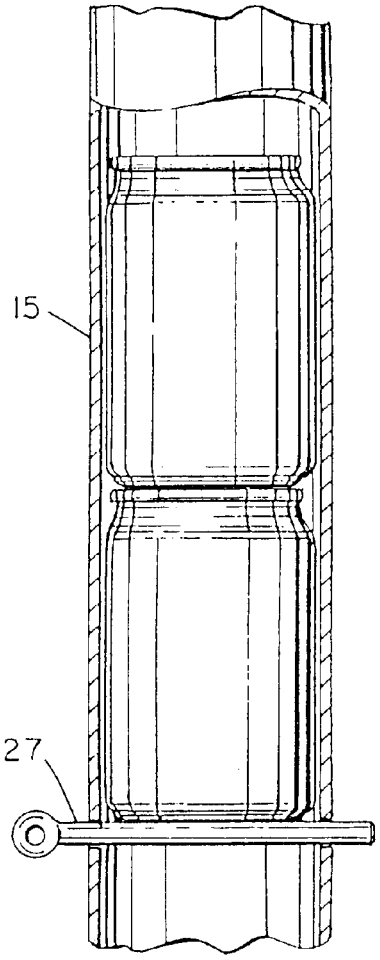
FIG. 9

PORTABLE PEDESTAL SEAT

This is a continuation in part application of a prior filed utility patent application having Ser. No. 08/322,180 filed on Feb. 16, 1995 which was at the time of this filing and now abandoned. Ser. No. 08/322,180 is, in turn, a continuation of Ser. No. 08/088,162 filed on Jul. 7, 1993 and is now abandoned.

DESCRIPTION OF THE INVENTION

1. Field of the Invention

This invention relates to pedestal type seats, and, more particularly, to a portable pedestal seat for convenient use by bird watchers, duck hunters, fishermen, or the like.

2. Background of the Invention

Bird watchers, duck hunters and fisherman oftentimes must stand for many hours waiting for fish to bite, or birds to fly in. If the hunter or fisherman is not in a boat, a seat is not usually available. It is of value and comfort for the bird watcher, hunter or fisherman to be able to be seated comfortably while waiting and watching. Sports seats are known in the prior art as follows as described below.

U.S. Pat. No. 1,956,956 teaches a stool designed to be staked into the ground and has spaced holes for a pin for adjustment as shown in FIG. 2 of the drawings. However, the invention disclosed in this prior art patent is quite different from that of the applicant's invention herein in that while the former invention incorporates a rod 5 which is tubular, it is not opened at the stop or foot piece which is designated as member 11 is employed to act as a stop to prevent rod 5 from sinking. The instant invention avoids the need for such an element.

U.S. Pat. No. 2,607,398 there is shown a combined stool and fishing rod support. A hollow tube 10 is used as a pedestal with a flattened end 14 for effectively penetrating the ground. An angle iron or metal strip 16 is used to function as a stop to prevent further penetration of the ground. A set screw 24 is used to adjust the crossbar 16 with respect to the tube 10. A seat is formed as a circular disk 30 which is mounted on the other end of the tube 10. This particular invention is quite different in structure and application than that of the invention disclosed herein. For example, the pedestal tube is closed at the penetrating end 14, while the applicant's invention requires that the end of the pedestal be open. Further, a horizontal leg 26 is used to function as an adjustable stop to prevent the pedestal from moving further into the ground or soil. The need for a stop such as this is eliminated by the applicants pedestal design which is accomplished by the use of a hollow end opening in the end of the pedestal which supports the seat.

U.S. Pat. No. 2,720,249, there is described as a vertically adjustable seat with a stake type point ground penetration. The pedestal 3 has a pointed end 22 to pierce the sand or gravel. A large, disk-shaped base 2 is used to effectively stop the pointed end 22 of the pedestal 3 from further penetration. The pedestal 3 is adjustable in length, but does not use a pin and hole combination. The entire structure is buoyant but cannot employ pins and holes for adjustment purposes and still remain buoyant. A set screw 23 is used instead for adjustment purposes.

U.S. Pat. No. 2,742,955, depicts a collapsible seat structure. The present invention disclosed and taught by the applicant herein does not incorporate or use a collapsible seat structure. What is shown and depicted in this reference is a collapsible seat, generally indicated at 11, which, when folded-up is stored in the hollow tube forming the support member 12, a pedestal portion, of this collapsible seat structure. Applicant's invention does not employ a collapsible seat, but simply a fixed seat. The seat of the applicant's invention is not stowed in the support member, or pedestal portion. Applicant's invention has an opening at the opposite end of the pedestal, or support member, whereas the reference employs a closed portion with a rubber insert to prevent sliding of the support member when in operative use.

U.S. Pat. No. 3,283,733 relates to a portable and collapsible sportsman's seat. A hollow rod 14 is used as a pedestal for the seat 12. The length of the pedestal is not adjustable. A shoulder means 18 is used to effectively stop the pedestal from penetrating further into the sand or gravel. A needle bearing 20 is provided at the opposite end of the pedestal for operatively mating with the recessed portion 24 of the underside of the seat. A length of cord 32 is provided as a means for carrying the combination seat and pedestal. The end of the hollow tube is flattened at 16 to allow relatively easy insertion of the pedestal into the ground, sand or gravel when the seat is to be used. Obviously, this invention is quite different than that discovered by the applicant.

U.S. Pat. No. 3,467,033 relates to a folding stool. A solid rod 23 and 27 are shown as the pedestal for the seat 10. A base 21 is secured to the bottom of the pedestal. At the bottom of the base 21 is incorporated a pair of tines 74 for penetration into the ground and stabilizing the pedestal when in use. A stop 75 is conveniently provided for limiting the upward movement of the tine assembly from the apertures 71. The applicant's pedestal seat structure does not relate to a folding stool nor to similar structure.

U.S. Pat. No. 4,098,478 is clearly and obviously quite different from the applicant's invention. A stop 56 is used as is incorporated into many of the other prior art designs discussed and disclosed herein.

U.S. Pat. No. D-309,989 is a design patent which relates to a portable stool for use primarily by hunters. This product consists of a seat, a lanyard connecting the seat and the pedestal, a stop and a pointed bottom portion. The pedestal is not shown to be adjustable. Further, the inventive structure disclosed therein is quite distinct from the applicant's invention taught herein.

SUMMARY OF THE INVENTION AND OBJECTS

Basically, there is shown and depicted in the present invention a portable pedestal seat for use with bird watching, fishing, and hunting activities. It consists of a seat portion, having integrally formed therewith, a relatively larger tube slidably accepting a smaller tube within it so that the pedestal may be extended to a desired length. The seat portion is typically formed of a disk-shaped element. A pin is connected via a lanyard to the seat which is used to both adjust the pair of tubes forming the seat support pedestal, and to lock the tubes with respect to each other by passing the pin through complementarily aligned holes in the tubes. The bottom of the inner tube is preferably cut on a bias of 45 degrees to allow improved penetration and disengagement of the tube with a soft ground surface. The hollow tubing with the holes therethrough provides a means for relieving the seat support from being held by suction in sand, mud or gravel. The lower tube normally extends fully into the ground. The upper tube also extends into the ground to a certain extent. The tubes provide a surface area that enables the tubes to penetrate the surface by a desired amount for stability of the device yet not further, so as to avoid difficult removal and a low position of the seat.

It is one primary and important object of the instant invention to provide an improved portable pedestal seat for convenient use by bird watchers, duck hunters, fishermen, or the like.

It is another object of the invention to provide an improved portable pedestal seat which is simple and rugged in construction.

It is an additional object and purpose of the invention to provide an improved pedestal seat of the type disclosed herein which is comfortable and can be used in a wide variety of ground types.

It is a further and primary object of the invention to provide an improved pedestal seat which is designed to penetrate ground surfaces over a range of ground surface consistencies from soft enough as to be difficult to walk upon without sinking, to relatively hard surfaces.

Another primary and important object of the present invention is to provide a telescopically adjustable pedestal that is constructed in such a manner as to avoid debris clogging.

Another important object of the present invention is to provide a telescopically adjustable pedestal that is constructed in such a manner as to telescopically extend over an appropriate range as to enable the tube to reach to a depth to provide stability to the pedestal in soft as well as hard surfaces.

A still further object of the invention is to provide a sports seat as described and shown here that is capable of supporting an appropriate weight while not requiring attachment elements for preventing the apparatus from sinking too deeply into the soil into which it is placed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIGS. 7–9 show other views of the present invention

DESCRIPTION OF THE PREFERRED EMBODIMENT

Figure 3:
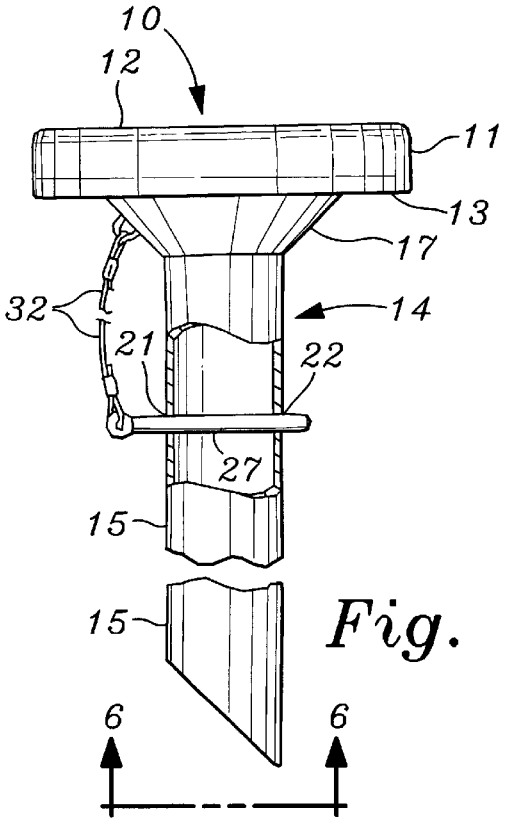
FIG. 3 is an enlarged view of portions of FIG. 1 shown in partial cutaway.
Figure 1:
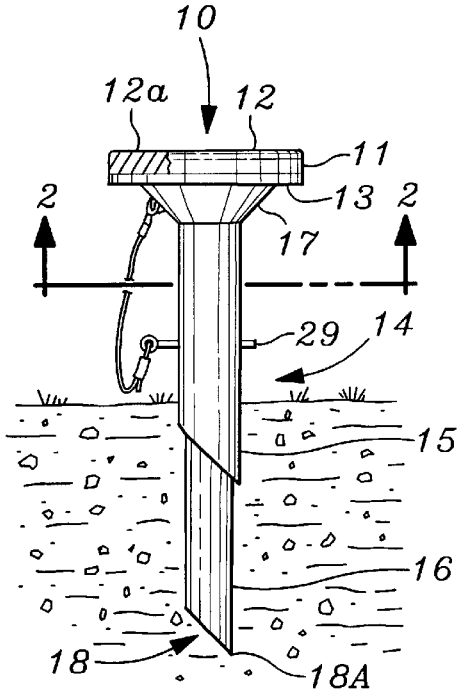
FIG. 1 is a side elevational view of the present invention as shown penetrating a ground surface by an appropriate degree for establishing stability.
Figure 2:
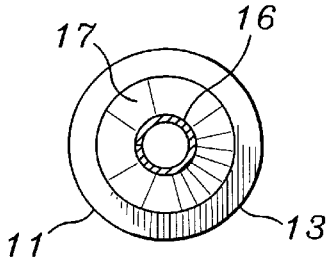
FIG. 2 is a section view thereof taken along line A—A of FIG. 1.
Figure 4:
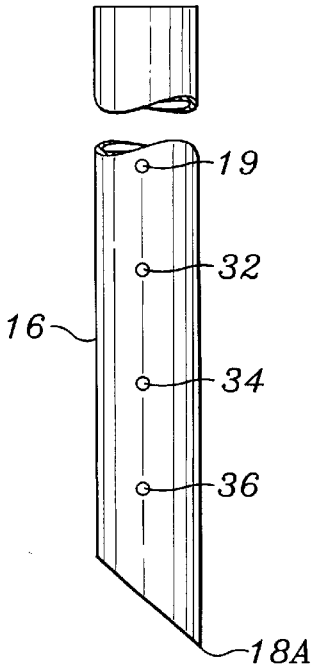
FIG. 4 is a side elevational view of the lower tube of the present invention.
Figure 5:
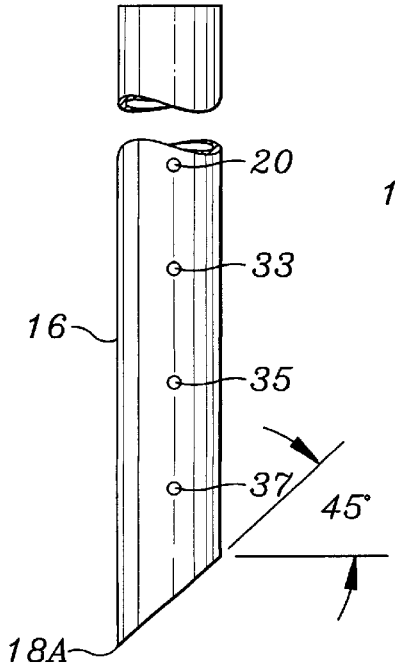
FIG. 5 is a side elevational view of the lower tube of the present invention showing the reverse side thereof.

With continued reference to all of the drawings herein, and with special emphasis now upon FIG. 1, there is shown a portable pedestal seat for use by bird watchers, duck hunters, fishermen, or the like, generally shown by reference numeral 10, including a seat 11, having a top surface 12 and a bottom portion 13, an adjustable pedestal or column, generally indicated at 14, and formed of a pair of tubes 15, 16. One of the tubes, tube 15 being larger in diameter than the other tube 16 and the smaller tube 16 being slidably mated inside the other tube 15. One end of the tube 15 is secured to the bottom portion 13 of the seat 11 via a flange 17 or any other means. The other tube 16 has its bottom end 18 cut on a biased angle, preferably 45 degrees, for promoting ease of penetration into the ground. The top portion 12 of the seat 11 is typically formed of a disk shaped element topped with a closed cell foam cushion, as shown in FIG. 1, for human seating comfort. Each of the tubes 15, 16 forming the adjustable pedestal 14 preferably has a plurality of pairs of complementarily aligned holes. Tube 15 has at least one pair of complementarily aligned holes 21, 22 therethrough; tube 16 has pairs of complementarily aligned holes 19, 20; 32, 33; 34, 35; and 36, 37 as shown in FIGS. 4 and 5 of the drawings. A pin 27 has forward end portion 29 which may be inserted into holes 21 and 22. The rear end portion may be gripped for use in pushing the pin 27 through the respective complementarily aligned holes in both tubes to form a rigid pedestal 14. In this manner the effective length of the pedestal 14 may be readily adjusted to suit an individual user's comfort level by providing for variations in such an individual user's height and more particularly, leg length. It is important to note that the lower tube 16 is inserted into the upper tube 15 so that debris falling downwardly cannot lodge between the tubes and so jamb sliding action between the tubes. This could happen, for instance, if small pebbles were to become wedged between the side walls of the two tubes.

The pin 27 is preferably connected via a lanyard 32 to the seat 11 so that in the event that the pin 27 is withdrawn from the holes it will not become lost since it is connected by means of the lanyard 32. In one form of desirable embodiment of the instant invention, the seat 11 is formed of a single piece of material such as plastic by injection molding, blow molding, or the like.

Figure 6:
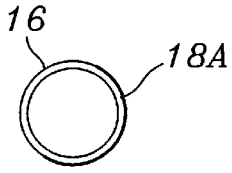
FIG. 6 is a plan view of an edge surface of the lower tube and is taken as view B—B in FIG. 3.

As described above and shown in FIG. 1, the portable pedestal seating device 10 is normally inserted into a soft ground 5 such as found at a beach, swamp blind, river bottom, river bank or other outdoor surface where a natural sport may be enjoyed. The interplay between the ground surface 5 and the instant device 10 is of utmost importance and will be further described presently. The invention includes a horizontally oriented seat 11 constructed of a buoyant material such as a structural plastic, and of such size as to accept an adult seated upon an upwardly facing surface 12 thereof. A vertically oriented tubular pedestal 14 is also constructed of a buoyant material such as a structural plastic. The pedestal 14 is fixed to an underside 13 of the seat 11 and extendes downwardly therefrom to terminate at a free end 18 providing a terminal lip surface 18A as best seen in FIG. 6. The lip surface 18A assumes an angle of approximately 45–60 degrees with the surface of the soft ground 5, the lip surface 18A presenting a surface area of between approximately 1.318 and 2.431 square inches with a wall thickness of approximately ⅛ inch, whereby the free end 18 of the tubular pedestal 16 penetrates the ground surface 5 deeply enough to reach more stable sub-soils that can stabilize the invention and prevent it from sinking fully into the ground. It has been found that these sub-soils are more dense then the upper soil levels and yet are often not too deep for the pedestal column to reach when the instant invention is inserted into the ground. It has been discovered that most natural ground conditions can support the instant invention in an upright attitude as shown in FIG. 1, if the pedestal is extensible over a range of from 36 inches to 56 inches. The pedestal will sink into the ground surface by between 18 and 24 inches on average. It is important that penetration should not be much greater or it becomes too difficult of the average person to remove the seat from the ground. Penetration is also slowed by the fact that the edge of the upper tube also penetrates the soil surface presenting resistance to further penetration. Also, if insertion is much less, the seat is not stable. It has been discovered that the diameters and terminal edge surface area ranges taught in the present invention enables the invention to be placed with stability and yet ease of removal. Your applicant has discovered by experimentation and analysis that the use of a lip surface area within the above specified range enables the device to present enough interference with the ground so that the amount of penetration of the device falls into the range specified. This is an important understanding because it allows the creation of a seating device having valuable usefulness in the specified field. Such usefulness can be obtained by a more elaborate device having means for the prevention of sinking such as is found in the prior art, but these additional features require additional cost of construction. The present device is very simple and therefore inexpensive to produce, yet provides a surprising result in its ability to interact with typical ground conditions to penetrate only so far and not further so as to provide a stable attitude and yet support an adult's weight. It has been found that if the lip surface 18A has an area less then the specified range, the seating device tends to continue to sink into subsoils until such depth is reached whereby it is quite difficult to remove from the surface with breaking the device. In cases where the surface area 18A is greater then the specified range, the device tends to be too difficult to insert so as to form a stable seat that can be relied upon to remain upright during normal use. The combination of the 45 degree angle of the free end 18 and the specified surface area 18A has been discovered to enable relatively easy initial penetration of the seating device into soft surfaces, proper depth of penetration, and relatively easy removal when necessary. It is noted that there are certain ground surfaces that do not provide a beneficial interaction with the present invention. The invention is not to be used with hard or firm ground surfaces, but only with surfaces of sand and soil of a certain wetness and firmness. However, it has been found that the desired interaction, as described above, has been obtained when using the present invention with a very wide range of sand and soil conditions and indeed such a range as to allow the use of the present invention with almost all natural conditions. The present invention has been widely tested in beach, marsh and river locations and it has been found that most of the grounds in these locations provide a soft upper surface but tend to become more dense and less soft below the upper surface. It is therefore a surprising result that such a seating device as presently discovered is able to sink into the earth by a certain amount and yet tend to stop sinking after a certain penetration. This discovery has resulted in the present inventive construction which is both simple and inexpensive to construct and yet yields surprising results when used in the manner shown herein.

It has been discovered that it is advantageous, with respect to the objectives of this invention to produce the invention with an outside diameter of the tubular pedestal in the range of between approximately 2½ and 4½ inches. Such a size is easily extruded, is light for facilitating carrying, and is strong enough, when produced with a wall thickness of approximately ⅛ inch (0.125 inches), to support very rough handling and dynamic loads of up to 250 pounds. Such a size produces the very desirable above specified surface area 18A which has been discovered to enable the invention to function as taught in this description.

It is preferred that the tubular pedestal comprise an upper 15 and a lower 16, pair of open ended tubes, each of the tubes having a side wall with such dimensions that the two tubes fit tightly, but slidable one within the other for extension adjustment. That is, the lower 16 of the pair of tubes 15, 16 being slidably engaged within the upper 15 of the tubes such that the pair of tubes forms a vertically extensible column 14. Also it desirable to provide a means for adjusting the tubes 15, 16 for selecting the length of the extensible column 14 over the discovered enabling range of from 36 to 56 inches.

The adjusting means provides a plurality of diametrically opposed holes as described above, through the side wall of each of the tubes, and further includes a pin 27 of such length as to extend through any one of the pairs of diametrically opposed holes in the one of the pairs of tubes and also through any one of the pairs of diametrically opposed holes in the other one of the pairs of tubes when such pairs of holes are aligned so as to lock the tubes at any one of a selected plurality of positions for fixing the length of the pair of tubes so as to adjust the height of the seat. Other adjusting means will be equally facilitus as will occur to those of skill in the art. However, a second benefit is obtained when the adjusting means is the holes shown in FIGS. 4 and 5 and such a second benefit is important to the use of the invention. Preferably, the sum of the areas of all of the holes in the side walls is at least 1 square inch, whereby air flows freely from within the tubes when the tubes are pressed into the ground surface, and air flows freely into the tubes for preventing suction lock from developing within the tubes when the tubes are removed or pulled out of the ground 5. This is an important improvement in the present invention because soft clay and other ground materials tend to stick to the lower tube 16 and tend to seal the tube 16 with the ground so that removal is difficult. When enough air is not able to flow into the tubes during removal from the ground, suction causes the ground to hold fast to the tubes thereby resisting further removal. It has been discovered that an opening through the walls of the pedestal 14 must be at least 1 inch in diameter in order to facilitate convenient removal from the average ground surface. It is believed that this discovery is important to the construction of a seating device, such as the instant device, for use as shown, that is able to be easily inserted into and removed from the ground 5.

Other modifications and changes in the present invention will occur to those skilled in the art to which this invention pertains. It should be clearly understood, however, that such obvious modifications and changes will not depart from the spirit and scope of the invention as presently disclosed, such changes and modifications being encompassed within the bounds of the scope of the within invention.

What is claimed is:

1. A portable pedestal seating device for placement into a soft ground, the device comprising:

a horizontally oriented seat constructed of a buoyant material and of such size as to accept an adult seated upon an upwardly facing surface thereof;

a vertically oriented pedestal constructed of a buoyant material, the pedestal fixed to an underside of the seat and extending downwardly therefrom to terminate at a free end providing a terminal lip surface, the lip surface assuming an angle of between approximately 45–60 degrees with the surface of the soft ground for improved penetration thereof, the pedestal comprising an upper open ended tube and a lower open ended tube, each of the tubes having a side wall;

the lower of the tubes being slidably engaged within the upper of the tubes such that the tubes, taken together, form a vertically extensible column, extendable over a length range of from 36 to 56 inches such that with the column inserted into the soft ground the column may be extended such that the free end reaches stable subsoil for providing stability to the seating device over a range of stable subsoil depths typical in hunting and fishing locations.

2. The device of claim 1 wherein the lip surface presents a surface area of between approximately 1.318 and 2.431 square inches for presenting an appropriate resistance to penetration into the stable subsoil.

3. The device of claim 1 wherein the outside diameter of the lower open ended tube is between approximately 2½ and 4½ inches and the wall thickness is approximately ⅛ inch.

4. The device of claim 3 wherein an adjusting means provides a plurality of diametrically opposed holes through the side wall of each of the tubes, and further including a pin of such length as to extend through any one of pairs of the diametrically opposed holes in one of the pairs of tubes and also through any one of pairs of diametrically opposed holes in the other one of the pairs of tubes when such pairs of holes are aligned so as to lock the tubes at any one of a selected plurality of positions for fixing the length of the pair of tubes so as to adjust the height of the seat.

5. The device of claim 4 wherein the sum of the areas of all of the holes in the side walls is at least 1 square inch, whereby air flows freely from within the tubes when the tubes are pressed into the ground surface, and air flows freely into the tubes for preventing suction from developing within the tubes when the tubes are removed therefrom.

6. The device of claim 1 further comprising a lanyard secured at one end to a pin and secured at the other end to the seat.

* * * * *